US010557275B2

(12) United States Patent
Lescord et al.

(10) Patent No.: US 10,557,275 B2
(45) Date of Patent: Feb. 11, 2020

(54) PLATFORM SYSTEM WITH MOVEABLE DIVIDERS

(71) Applicants: Wade M. Lescord, Mt. Pleasant, SC (US); Paul Spies, Mt. Pleasant, SC (US)

(72) Inventors: Wade M. Lescord, Mt. Pleasant, SC (US); Paul Spies, Mt. Pleasant, SC (US)

( * ) Notice: Subject to any disclaimer, the term of this patent is extended or adjusted under 35 U.S.C. 154(b) by 100 days.

(21) Appl. No.: 15/673,066

(22) Filed: Aug. 9, 2017

(65) Prior Publication Data

US 2018/0051473 A1 Feb. 22, 2018

Related U.S. Application Data

(60) Provisional application No. 62/376,613, filed on Aug. 18, 2016.

(51) Int. Cl.

| | |
|---|---|
| ***B60R 7/02*** | (2006.01) |
| ***E04G 1/15*** | (2006.01) |
| ***E04G 11/36*** | (2006.01) |
| ***E04G 1/34*** | (2006.01) |
| ***E04G 1/36*** | (2006.01) |
| ***E04G 5/06*** | (2006.01) |
| ***E04G 7/02*** | (2006.01) |

(52) U.S. Cl.

CPC ..... *E04G 1/15* (2013.01); *E04G 1/34* (2013.01); *E04G 1/36* (2013.01); *E04G 5/061* (2013.01); *E04G 7/02* (2013.01); *E04G 11/36* (2013.01)

(58) Field of Classification Search

CPC ..... E04F 15/105; E04F 15/02194; E04F 2201/095; E04H 1/1205; E04B 1/34321; A63H 33/08; A63H 33/086; B60R 7/02; B60R 13/01

See application file for complete search history.

(56) References Cited

U.S. PATENT DOCUMENTS

| | | | | | |
|---|---|---|---|---|---|
| 3,902,291 | A * | 9/1975 | Zucht | G09B 25/04 | 52/284 |
| 4,027,892 | A | 6/1977 | Parks | | |
| 4,358,035 | A * | 11/1982 | Heidecker | B60R 7/02 | 220/533 |
| 4,917,429 | A | 4/1990 | Giger | | |
| 5,044,682 | A | 9/1991 | Wayne | | |
| 5,240,301 | A | 8/1993 | Arnold | | |
| 5,265,993 | A | 11/1993 | Wayne | | |

(Continued)

OTHER PUBLICATIONS

Signature Fencing; How to Install EcoDeck Exhibit Flooring—Fast; YouTube; Published Aug. 12, 2010; https://www.youtube.com/watch?v=yvALKarKUo8&feature = youtube.entire video.

*Primary Examiner* — Brian D Mattei
*Assistant Examiner* — Daniel J Kenny
(74) *Attorney, Agent, or Firm* — B. Craig Killough; Barnwell Whaley Patterson & Whaley

(57) ABSTRACT

A modular system for forming a floor or platform. The modular system may have vertical dividers for forming divided sections. Multiple horizontal sections are positioned in a side by side arrangement and connected with connectors to form the platform or floor in a desired shape and coverage. Vertical dividers inserted into the horizontal sections and retained in the horizontal sections provide separation of the modular system into compartments.

20 Claims, 13 Drawing Sheets

(56) References Cited

U.S. PATENT DOCUMENTS

| | | | | |
|---|---|---|---|---|
| 5,411,355 | A | 5/1995 | Gosnell et al. | |
| 5,423,463 | A | 6/1995 | Weeks | |
| 5,597,193 | A | 1/1997 | Conner | |
| 5,599,055 | A | 2/1997 | Brown | |
| 5,788,310 | A | 8/1998 | McKee | |
| 5,845,953 | A | 12/1998 | Rusnock | |
| 5,931,632 | A | 8/1999 | Dongilli et al. | |
| 6,022,062 | A | 2/2000 | Fleenor | |
| 6,135,527 | A | 10/2000 | Bily | |
| 6,138,883 | A | 10/2000 | Jackson et al. | |
| 6,174,116 | B1 | 1/2001 | Brand | |
| 6,176,657 | B1 | 1/2001 | Romph | |
| 6,267,427 | B1 | 7/2001 | Ziehl | |
| 6,478,356 | B1 | 11/2002 | Wayne | |
| 6,644,712 | B1 | 11/2003 | Rafi-Zadeh | |
| 6,688,821 | B1 | 2/2004 | Snyder | |
| 6,890,138 | B1 | 5/2005 | Myrick | |
| 6,979,037 | B2 | 12/2005 | Morrison | |
| 7,914,228 | B2 * | 3/2011 | Rapaz | E01C 5/005 404/34 |
| 8,029,219 | B2 | 10/2011 | Toutant et al. | |
| 8,070,029 | B1 | 12/2011 | Settle | |
| 8,100,615 | B1 | 1/2012 | Freeborn | |
| 8,128,311 | B2 * | 3/2012 | Son | A63C 19/04 403/326 |
| 8,371,782 | B2 | 2/2013 | Hill | |
| 8,683,769 | B2 * | 4/2014 | Cerny | E01C 5/001 404/36 |
| 8,800,216 | B2 * | 8/2014 | Phillips | E04H 1/1205 446/108 |
| 8,931,987 | B2 | 1/2015 | Hibbard | |
| 9,032,670 | B2 * | 5/2015 | Vogler | E04B 1/34321 52/79.9 |
| 9,067,521 | B1 | 6/2015 | Masanek, Jr. et al. | |
| 9,168,874 | B2 | 10/2015 | Smith et al. | |
| 9,227,570 | B2 | 1/2016 | Fleet, Sr. | |
| 9,695,590 | B2 * | 7/2017 | Amend | E04C 2/26 |
| 2007/0006544 | A1 | 1/2007 | Washburn | |
| 2008/0169674 | A1 | 7/2008 | Giles | |

* cited by examiner

PLATFORM SYSTEM WITH MOVEABLE DIVIDERS

Applicant claims the benefit of U.S. Provisional Patent Application Ser. No. 62/376,613 filed Aug. 18, 2016.

SUMMARY OF THE INVENTION

A modular system for forming a floor or platform is disclosed. The modular system may have vertical dividers for forming divided areas. Multiple horizontal sections are positioned in a side by side arrangement and connected with connectors to form the platform or floor in a desired shape and coverage. Vertical dividers inserted into the horizontal sections and retained in the horizontal sections provide separation of the modular system to form compartments.

BRIEF DRAWING DESCRIPTION

Figure 12:
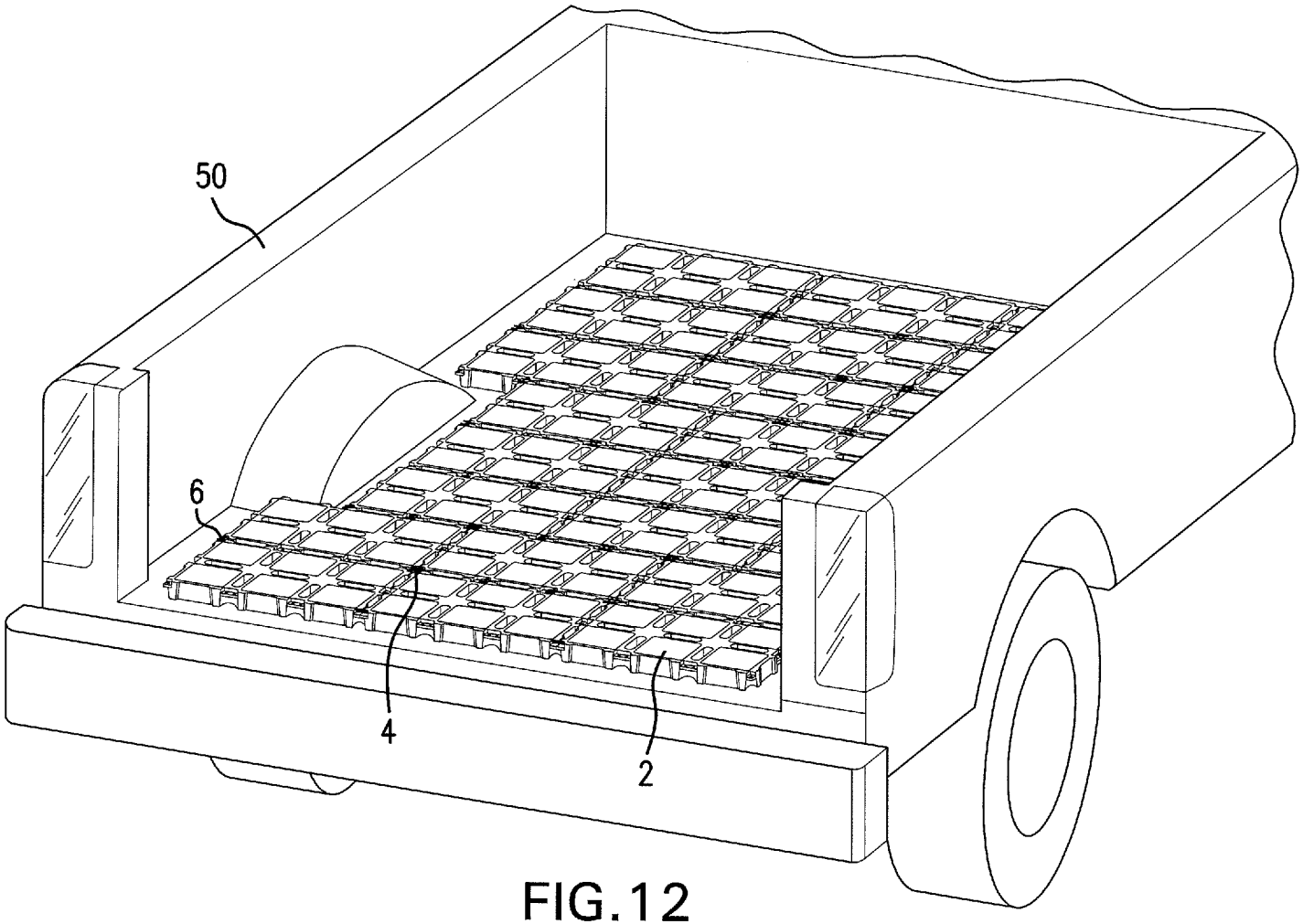

FIG. 12 demonstrates in perspective an application of the platform system formed of horizontal interlocking floor sections according to the invention, and positioned in a truck bed.

Figure 4:
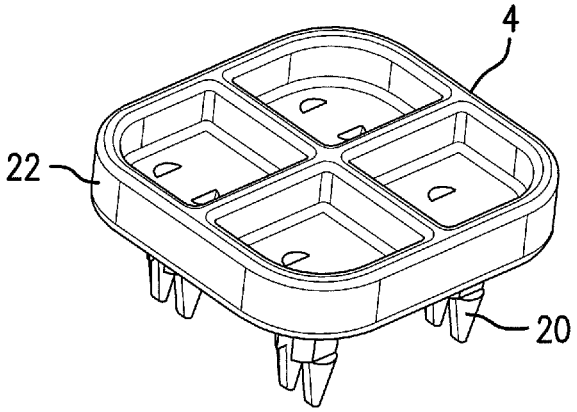
FIG. 4 is a perspective view of an embodiment of a connector for joining sections of interlocking floor sections.
Figure 7:
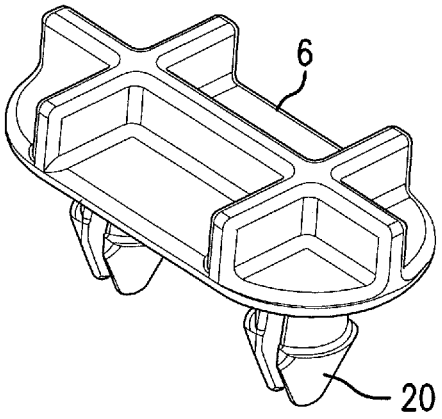
FIG. 7 is a perspective view of another embodiment of a connector for joining sections of interlocking floor sections.
Figure 13:
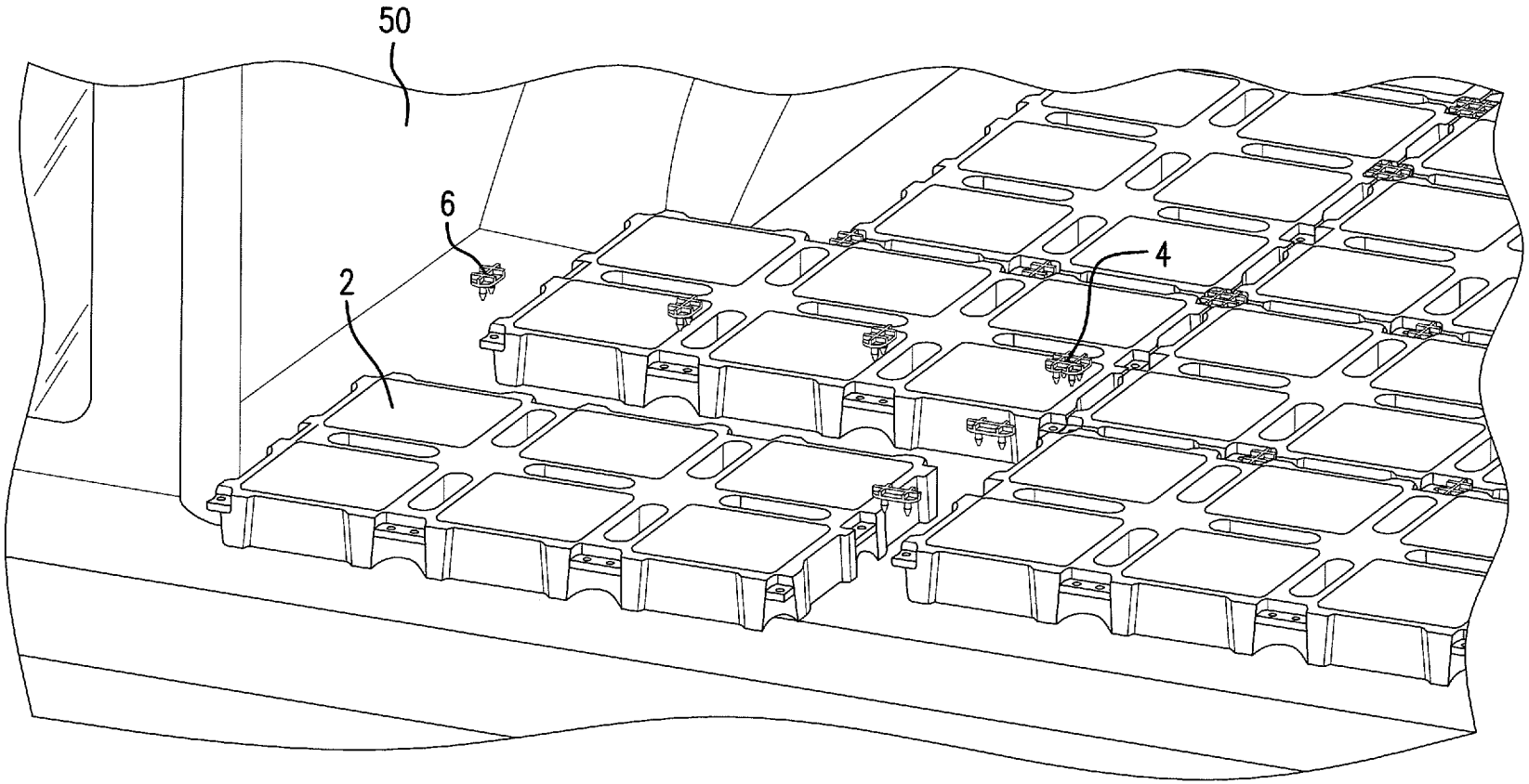

FIG. 13 is an enlarged partial view of the horizontal interlocking floor section system of FIG. 12 demonstrating positioning of connectors to join units of interlocking floor sections using the connectors of FIG. 4 and FIG. 7.

Figure 14:
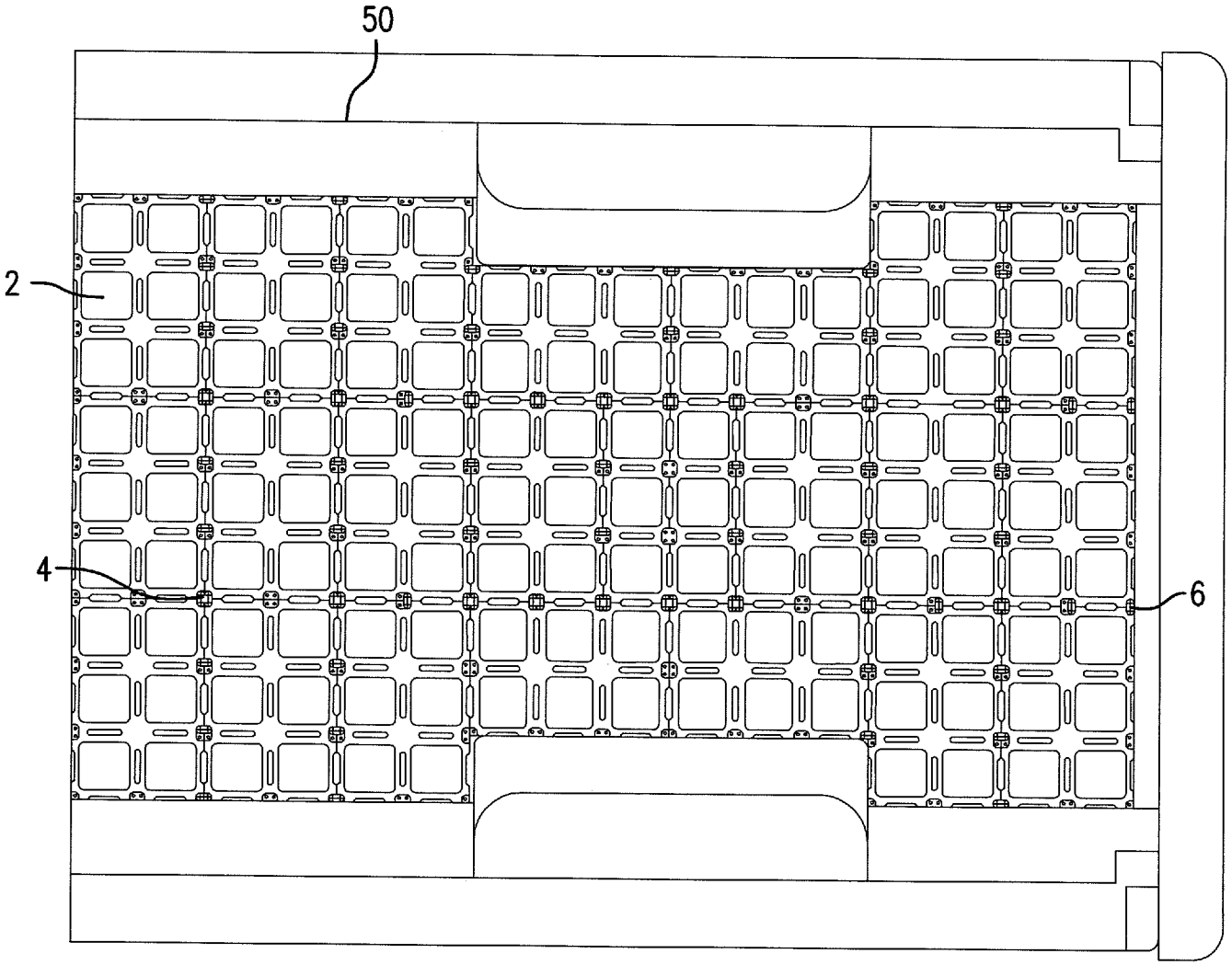

FIG. 14 is a top plan view of the platform system formed of horizontal interlocking floor sections according to the invention, and positioned in a truck bed.

Figure 10:
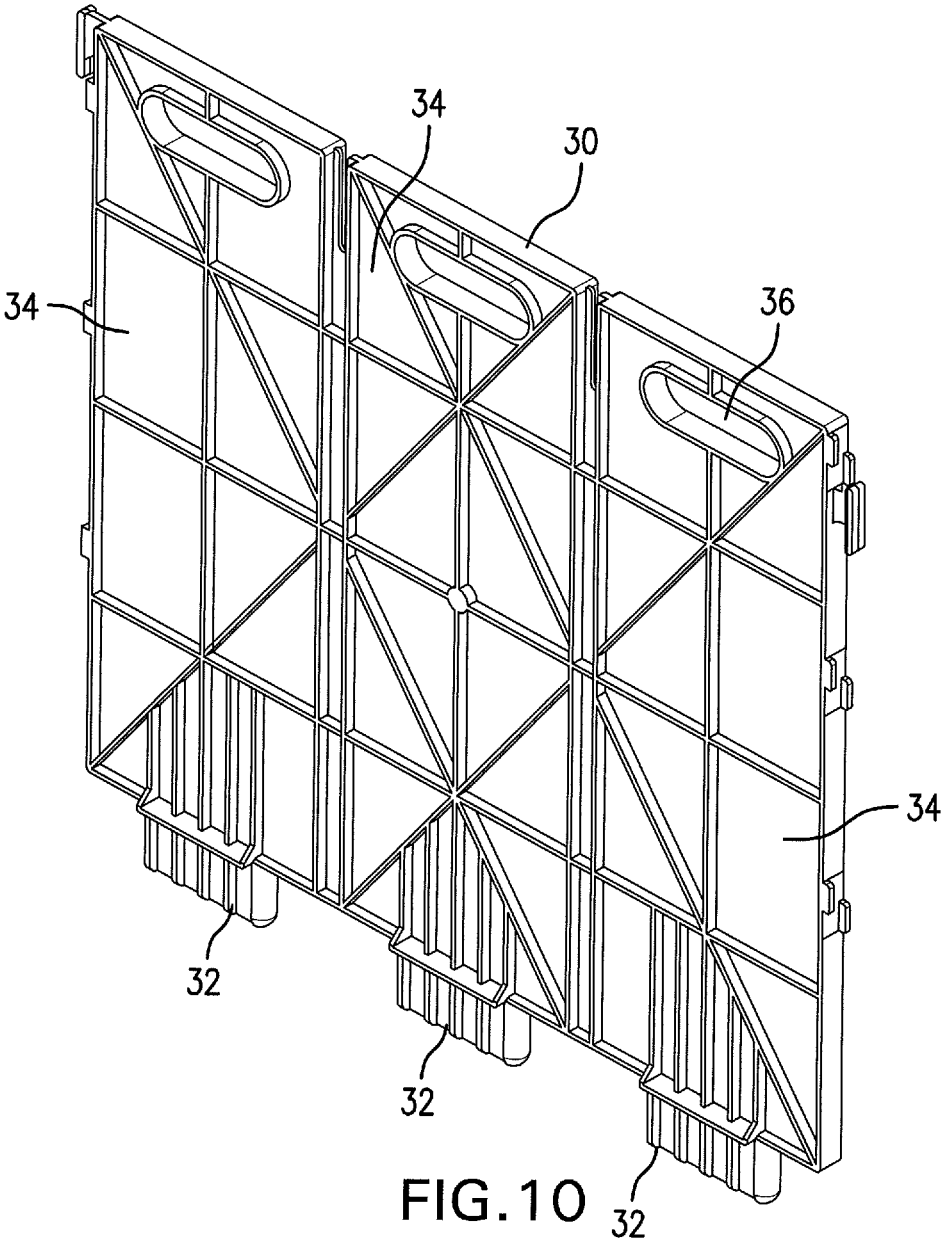
FIG. 10 is a perspective view of an embodiment of a vertical divider that joins with the interlocking floor sections according to the invention.
Figure 11:
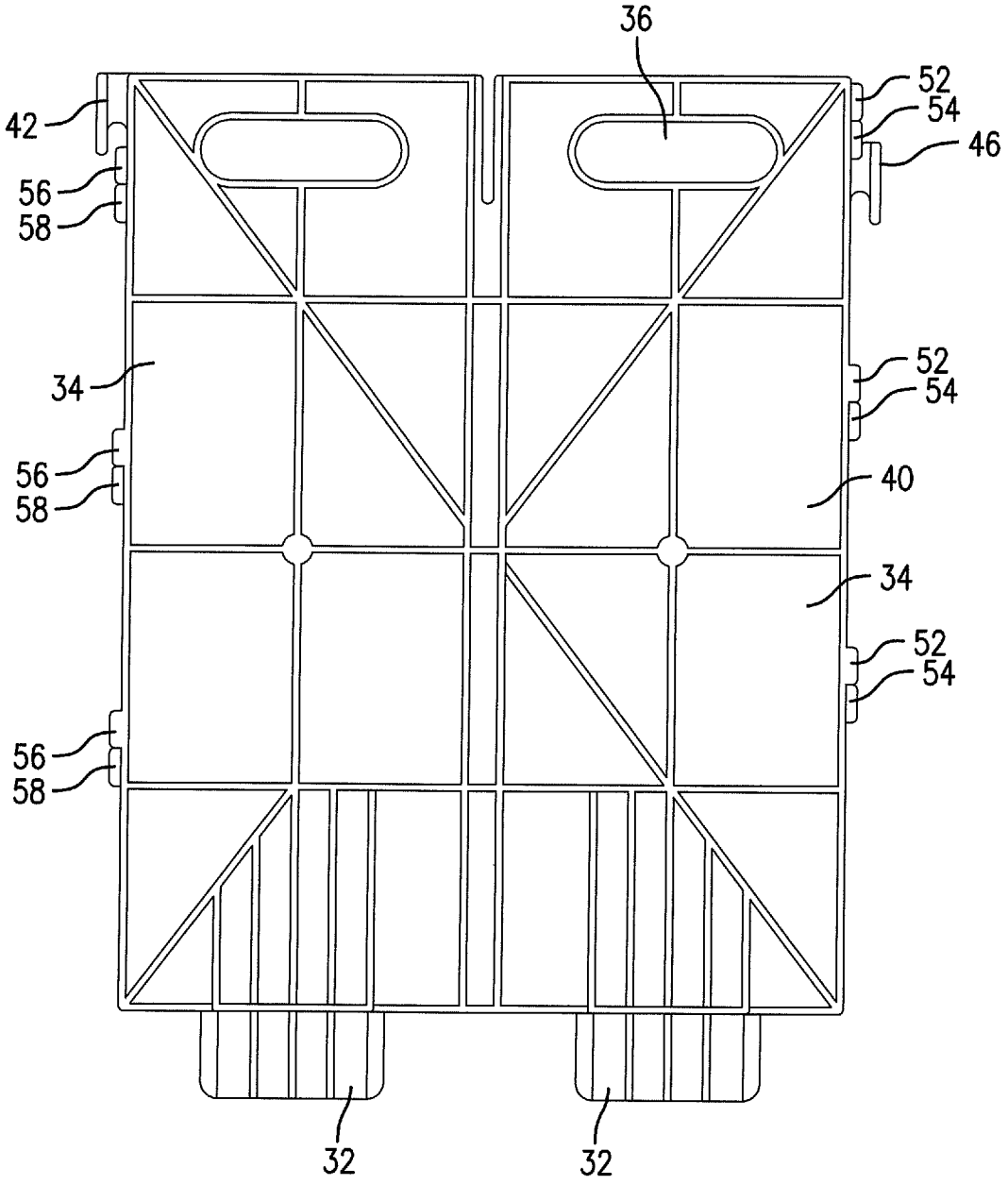
FIG. 11 is an elevation of an embodiment of a vertical divider that joins with the interlocking floor sections.
Figure 15:
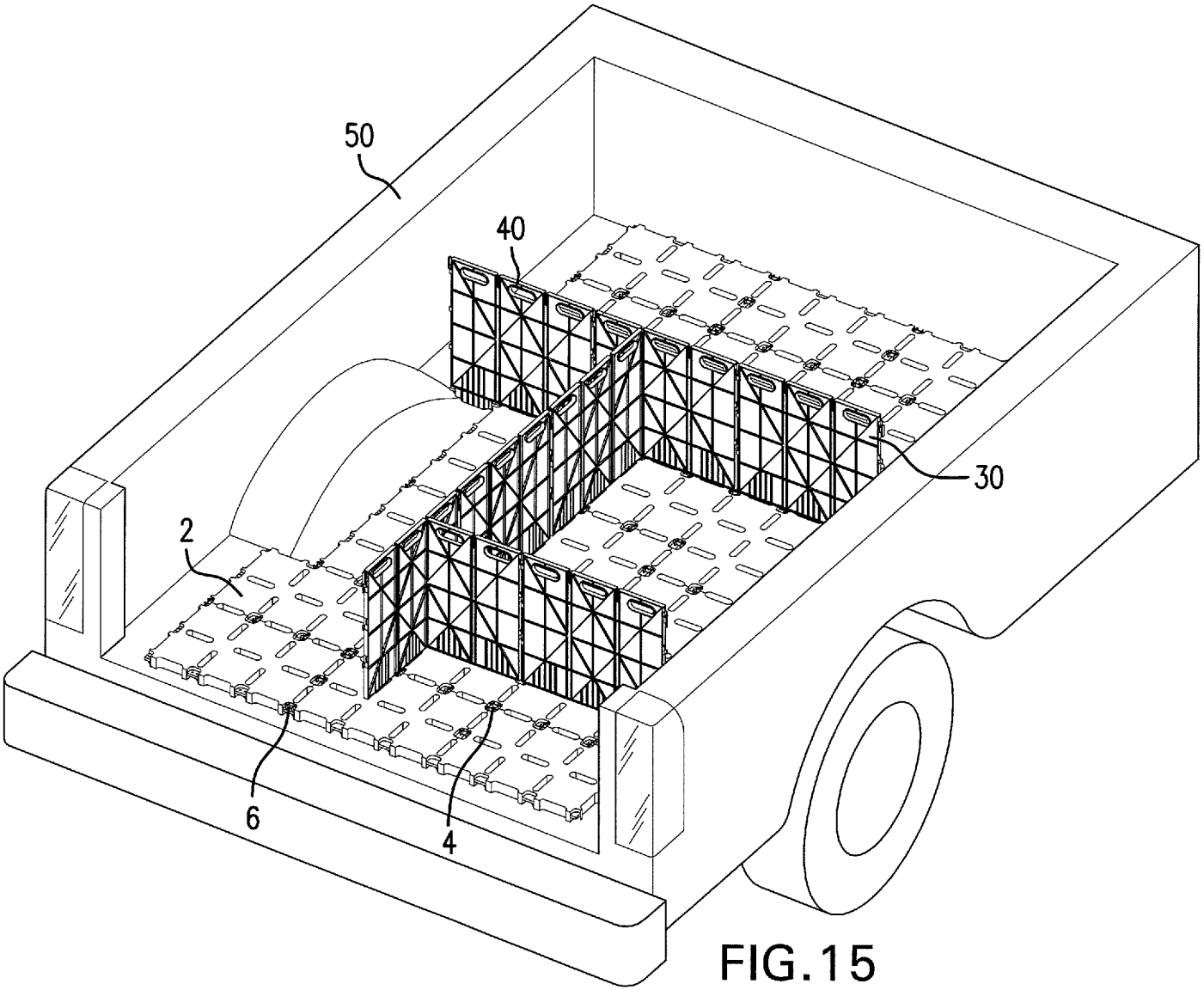

FIG. 15 is a perspective view showing the vertical dividers of FIG. 10 and FIG. 11 joined to the horizontal interlocking floor section system according to the invention to form sections within a bed of a truck.

Figure 16:
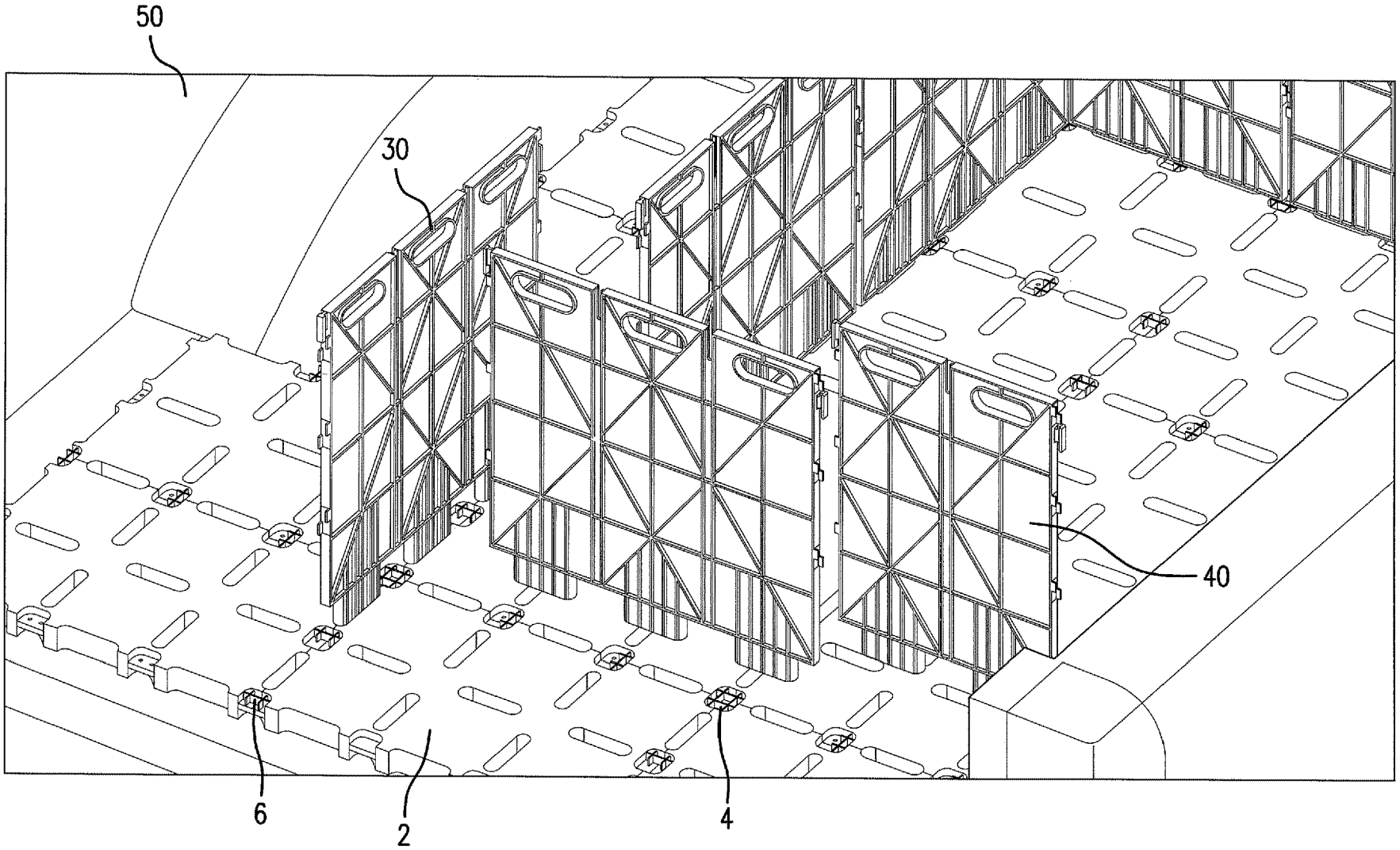

FIG. 16 is a partial, enlarged view of FIG. 15 demonstrating insertion of the vertical dividers into the horizontal floor system according to the invention.

Figure 17:
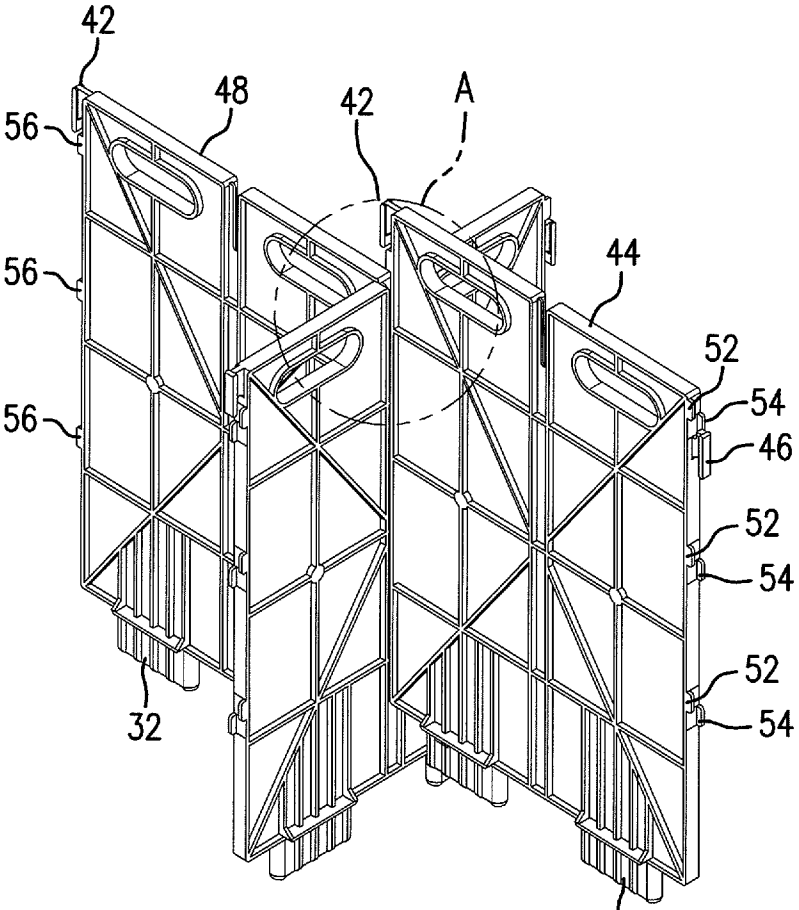

FIG. 17 is a perspective view of four (4) vertical dividers.

Figure 18:
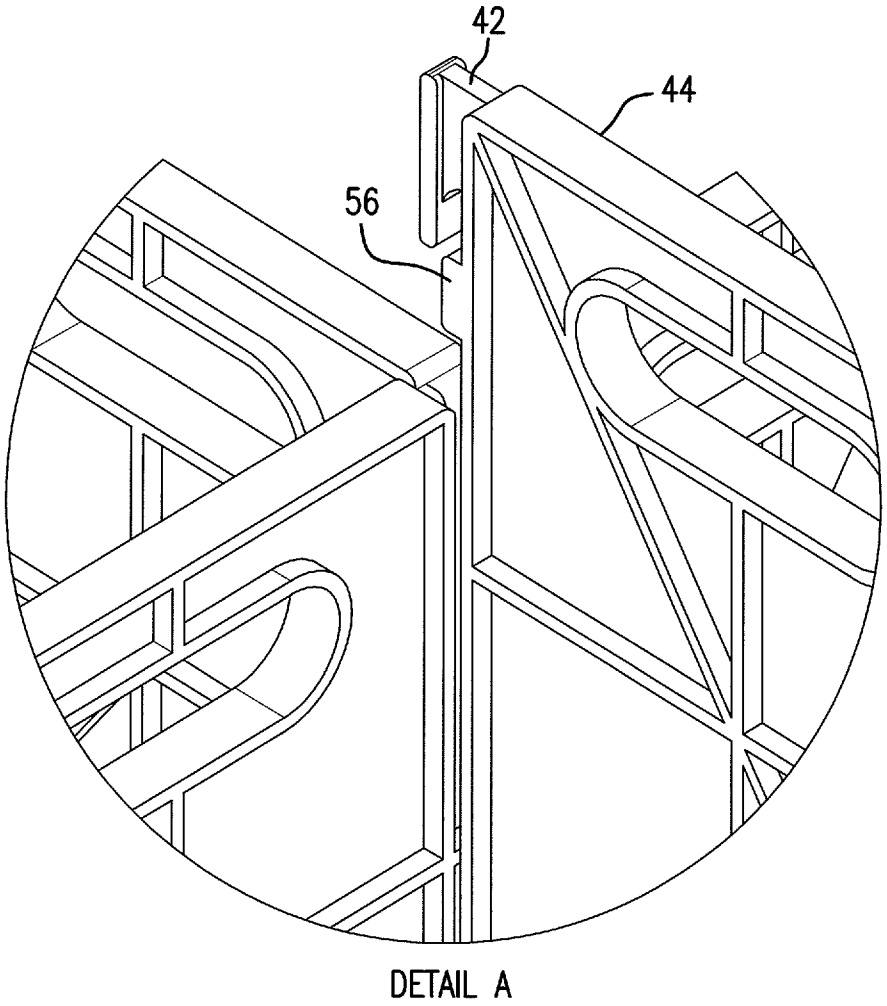

FIG. 18 is an isolation taken from Detail A of FIG. 17.

Figure 19:
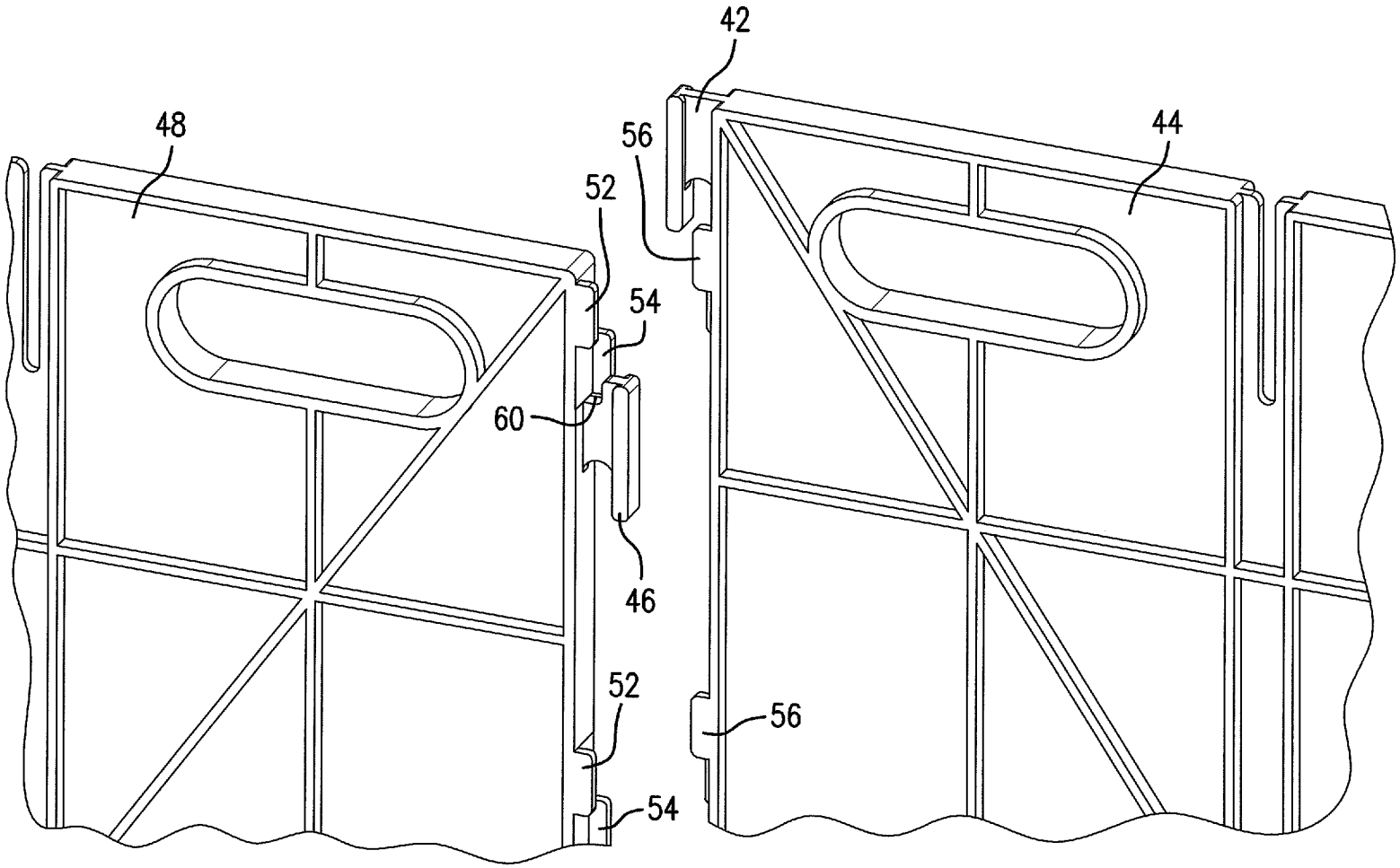

FIG. 19 is a partial view of two (2) vertical dividers.

Figure 20:
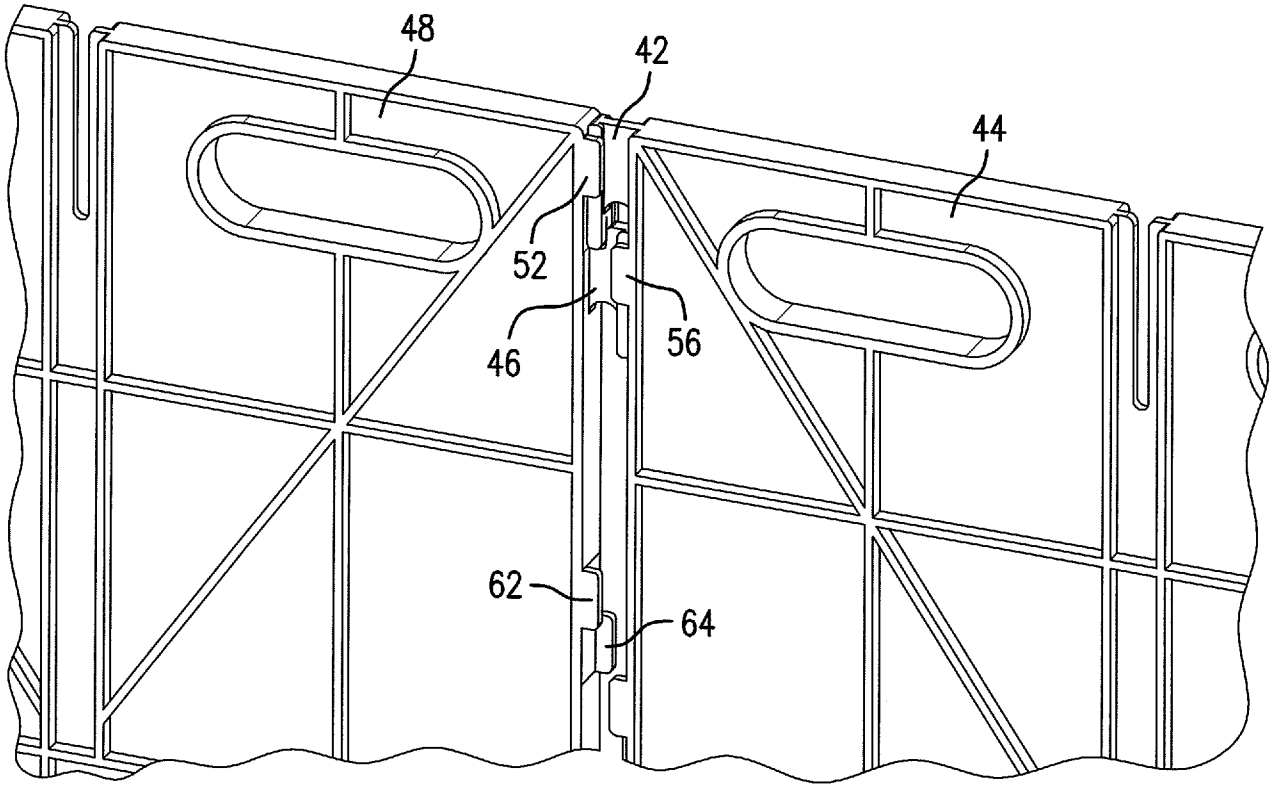

FIG. 20 demonstrates connection of the two (2) vertical dividers of FIG. 19.

DESCRIPTION OF PREFERRED EMBODIMENTS

Figure 1:
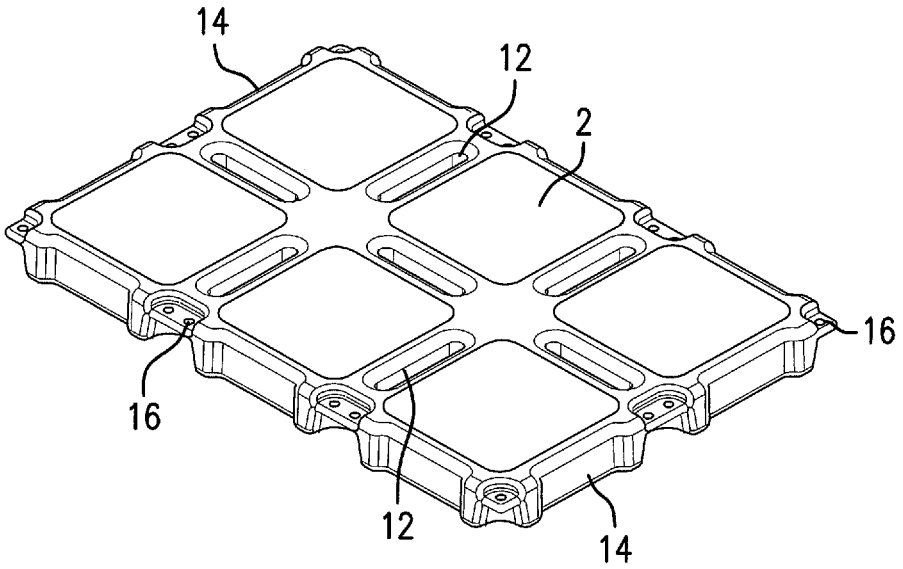
FIG. 1 is a perspective view of a single unit of a horizontal floor section according to an embodiment of the platform system.
Figure 2:
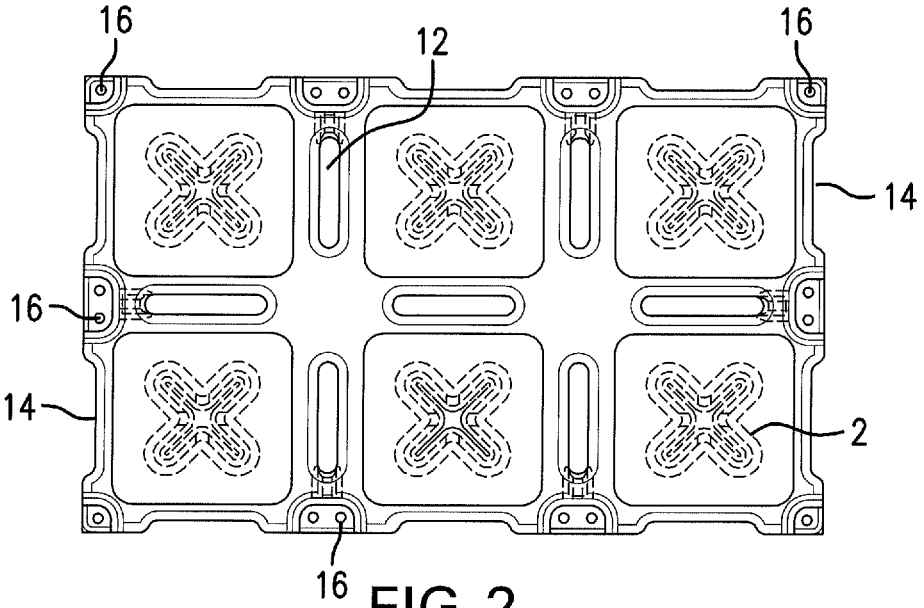
FIG. 2 is a top plan view of a single unit of a horizontal floor section according to an embodiment of the platform system.
Figure 3:
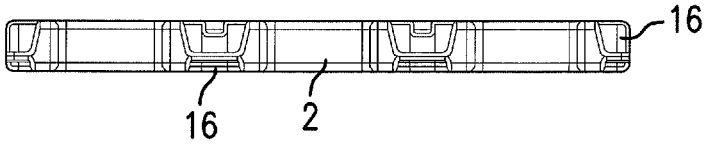
FIG. 3 is a side elevation of a single unit of a horizontal floor section according to an embodiment of the platform system.

FIG. 1 through FIG. 3 show an embodiment of a unit of a horizontal floor section 2 according to the invention. The horizontal floor section as shown has a plurality of receiving apertures 12 formed therein for receiving and holding vertical dividers as shown in FIG. 10 and FIG. 11. The receiving apertures are spaced apart and may be elongated like slots.

A receiving aperture is formed between adjoining horizontal floor sections in this embodiment with each adjoining section contributing a semi-aperture 14 (that is, half of the aperture). The side by side and connected floor sections form a receiving aperture between them for receiving dividers.

Each unit of horizontal floor section 2 also comprises receptacles 16 for receiving connectors 4,6. In this embodiment, a receptacle is formed on each of the four (4) corners of a floor section. A pair of receptacles (two receptacles positioned side by side) is formed about the perimeter of the floor section along each side of the floor section so as to be between each floor section when floor sections are connected. The pair of receptacles are recessed and positioned between areas of the floor section. A portion of the floor section 2 that comprises the receptacles is recessed below the adjoining top surface of the floor section, so that the connectors do not extend above the horizontal plane of the sections of the horizontal floor section. The receptacles may be cylindrical voids or apertures formed in the floor sections and located as shown in the drawings.

The horizontal floor section as shown in FIG. 2 has seven (7) receiving apertures 12 and a length that exceeds its width so as to be generally rectangular in shape. The horizontal floor section may be formed to other dimensions.

Figure 5:
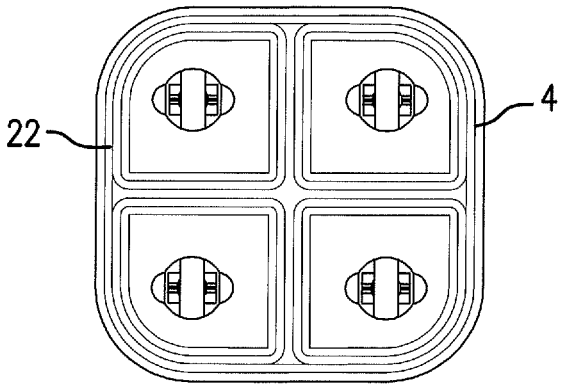
FIG. 5 is a top plan view of the embodiment of FIG. 4 of a connector for joining sections of interlocking floor sections.
Figure 6:
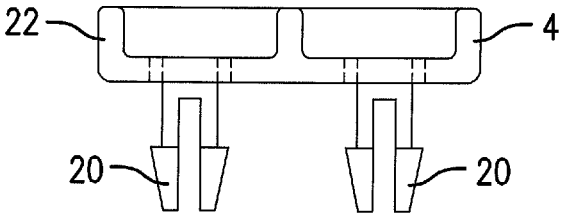
FIG. 6 is a side elevation of the embodiment of FIG. 4 of a connector for joining sections of interlocking floor sections.

An embodiment of a connector 4 is shown in FIGS. 4, 5, and 6. In this embodiment, a connector comprises four vertical protrusions 20 that extend downwardly from the top member 22 of the connector. The top member joins the four protrusions. The protrusions may be spaced apart, and have a reduced dimension from a top portion and/or mid-portion which progresses toward the bottom of each protrusion. FIG. 6. The split configuration and reduction in dimension aids in inserting the protrusions into the receptacles 16 of the horizontal floor section and retaining the connectors within the receptacle, as each side of the protrusion is pushed toward the other side during insertion, with shape memory characteristics applying a retaining force as the sides of each protrusion then push in opposite directions.

In some applications, it is not desirable to use a connector having four protrusions. For example, at the borders of the system formed by a plurality of horizontal floor sections, only two (2) receptacles are available for joinder, and a connector 6 that only has two (2) protrusions 20 is useful. Otherwise, the connector 4 with four protrusions will extend beyond the edge of the horizontal floor system in an undesired manner. There may be other applications where connection by four protrusions is either unnecessary or undesired, and the connector 6 is preferable. The connectors may be formed with raised cross-members on a surface that is opposite the protrusions to increase structural integrity of the connectors 4, 6.

A particular application for the invention has a divider 30, 40 that can be used in a vehicle, such as a bed of a truck 50, a trailer, or a cargo area of an automobile, SUV or station wagon. FIGS. 12 through 16 demonstrate the device being used to selectively form divided sections in a bed of a pick-up truck. A similar application may be used in other vehicles, such as in trains, buses, and airplanes, or in and around buildings, such for decks, floors, and mezzanines, by way of examples and not limitation.

Figure 8:
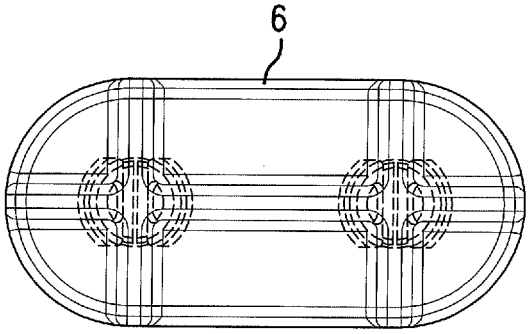
FIG. 8 is a top plan view of the embodiment of FIG. 7 of a connector for joining sections of interlocking floor sections.
Figure 9:
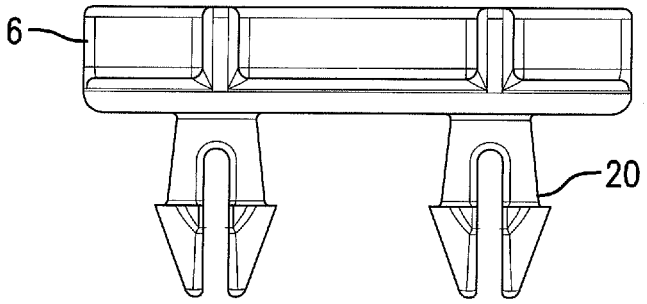
FIG. 9 is an elevation of the embodiment of FIG. 7 of a connector for joining sections of interlocking floor sections.

The units of horizontal floor sections 2 as shown in FIGS. 1 through 3 are joined together with the connectors shown in FIGS. 4 through 6 and/or FIGS. 7 through 9. The individual units of floor sections may be of larger or smaller length and width, and have more or fewer sections, so as to allow a user to configure a horizontal floor system formed of the floor sections 2 to the required size and shape. For example, while the section 2 according to the embodiment of FIG. 1 has six squares that form the unitary section 2, the section could have as few as one or two such squares or similar areas as long as receptacles 16 are provided about the perimeter for connection of the floor section to other floor sections. Elongated receiving apertures 16 may be formed generally beside each square area/and on an interior of the floor sections, and generally parallel to each side and each end of the floor sections. FIG. 2.

By way of example, and not limitation, the unit of floor section 2 shown in FIG. 1 may have a length of 18 inches and width of 12 inches, meaning that each of the six (6) areas that make up the unit of floor section is about six inches by about six inches, minus the receiving apertures 12. The dimensions of the areas that comprise the unit of floor section sections may be increased or decreased as desired, and the number of areas may also be greater or fewer.

In many applications, individual floor sections 2 will be joined at their corners, with each corner having a receptacle 16. The connector 4 as shown in FIG. 4 may be used to join four (4) sections 2 at their corners by inserting the protrusions 20 of the connector 4 into the four available receptacles 16. Similarly, through the use of two receptacles 16 on the sides of floor sections, where a section 2 joins another unit of floor section along its side, four receptacles will be available, and the connector shown in FIG. 4 may be used to join these floor sections. See reference number 4 of FIG. 15. In some applications, connector 6 is sufficient for joining at the sides of the sections, or two connectors 6 may be used in place of one connector 4.

If the two floor sections 2 that are joined side by side are not joined to another floor section at the ends thereof, the connector 6 shown in FIG. 7 may be used at the ends, since each floor section at its corner lends a single receptacle 16, and four receptacles are not available due to the absence of additional floor sections at the ends.

Excepting at the ends where no floor section 2 adjoins another floor section, elongated receiving apertures 12 or slots are formed between the floor sections as shown in FIGS. 12 and 16. The vertical dividers 30, 40 have at least one blade 32 extending from the bottom of the divider that engages a receiving aperture. The dividers may be formed in a unit with two or more sections 34 as shown in FIG. 11, with a blade extending from each section. However, it may be desirable in some cases for the divider to have only one section that is half as long as the divider having two sections.

Similarly, the divider may have three or more sections. FIG. 10. The width of each section 34 is preferred to be substantially equal to the width of a section of the horizontal floor section 2, with the blade 32 having a width that allows it to fit within and be retained by the receiving aperture 12 formed in the horizontal floor section 2.

It is preferred that the vertical dividers can be joined to other vertical dividers to provide strength for the wall formed by the dividers. FIG. 20. In one embodiment, the dividers may be joined at right angles. FIG. 17. In another embodiment, the dividers may be joined side by side. FIG. 20.

FIG. 18 shows a connector of a divider joining another divider at a right angle, and joining still another divider at a right angle. The connectors are configured to permit joinder in this manner.

FIG. 19 shows connectors for dividers joined side by side to yield the connection shown in FIG. 20. A hook 42 is formed at or near the top of divider 44 and on an end of the divider. A hook 46 is formed lower on divider 48. Staggered guides 52, 54 receive and guide hook 42 to engage hook 46, and also engage the end of divider 44 to aid in holding the dividers in place. Guides 56 may also be formed on divider 44 to guide the engagement of hook 46, and also engage the end of divider 48 to aid in holding the dividers in place.

FIG. 20 shows the connectors engaging each other to connect the dividers. Hook 42 slides through guides 52,54 and is inserted into aperture 60 Additional guides 52,54, 56, 58 may be formed on each end of the dividers, FIG. 17, to assist in providing a secure connection. In a preferred embodiment, each divider has at least two (2) connector structures as described, with one of the connector structures formed on one end, and the other complimentary connector structure formed on the opposite end.

In a preferred embodiment, a hand hold 36 is associated with each section of the vertical divider. The vertical dividers 30,40 are retained within the receiving apertures 12 without additional fasteners by engagement with the blades. In this manner, the dividers may be quickly and easily pulled away from the horizontal floor sections using the handholds, and repositioned in other parts of the interlocking floor system. The divider configuration can be selected by the user, and easily rearranged as needed depending upon the load requirements or storage requirements of the application of the system.

The invention has particular utility for use with vehicles, such as providing a way to separate cargo in a bed or cargo section of a vehicle. The invention may also be used to separate materials and/or inventory in storage or on display. The size of the compartments formed by the dividers may be changed as needs change due to the type or quantity of inventory or material that is stored, retained or separated.

What is claimed:

1. A platform system, the platform system comprising:

a first horizontal section comprising a plurality of annular receptacles;

a second horizontal section comprising a plurality of annular receptacles;

a connector having a top member comprising a plurality of vertical protrusions the vertical protrusions extending downwardly from the top member of the connector, wherein a vertical protrusion of the plurality of vertical protrusions is inserted into and retained within a receptacle of the plurality of annular receptacles of the first horizontal section and another vertical protrusion of the plurality of vertical protrusions is inserted into and retained within a receptacle of the plurality of annular receptacles of the second horizontal section, the connector connecting the first horizontal section to the second horizontal section, and wherein a top surface of the top member of the connector does not extend above a top plane of the first horizonal section or a top plane of the second horizontal section, the platform system further comprising a vertical divider comprising a blade that is present within and retained by an annular receiving aperture formed in an interior of the first horizontal section, wherein the vertical divider is held in position by engagement of the blade with the annular receiving aperture of the first horizontal section.

2. A platform system as described in claim 1, wherein the first horizontal section comprises a corner annular receptacle of the plurality of annular receptacles on each of four corners of the first horizontal section, and the second horizontal section comprises a corner annular receptacle of the plurality of annular receptacles on each of four corners of the second horizontal section, and wherein the vertical protrusion of the plurality of vertical protrusions of the connector is inserted into a corner annular receptacle of the plurality of annular receptacles of the first horizontal section and the another vertical protrusion of the plurality of vertical protrusions is inserted into a corner annular receptacle of the plurality of annular receptacles of the second horizontal section, connecting the first horizontal section to the second horizontal section.

3. A platform system as described in claim 1, the obround receiving aperture formed by positioning a first side of the first horizontal section against a first side of the second horizontal section.

4. A platform system as described in claim 1, the obround receiving aperture formed by positioning a first side of the first horizontal section against a first side of the second horizontal section and a second obround receiving aperture constructed and arranged to receive a blade for a second vertical divider that extends upwardly from the first horizontal section and a third horizontal section, the second obround receiving aperture formed by positioning a first end of the first horizontal section against a first side of the third horizontal section.

5. A platform system as described in claim 1, wherein the first horizontal section comprises at least two annular receiving apertures each constructed and arranged to receive a blade of a vertical divider therein and formed in an interior of the first horizontal section and substantially parallel with a first side of the first horizontal section and at least two additional annular receiving apertures each constructed and arranged to receive a blade of a vertical divider therein and formed in an interior of the first horizontal section and substantially parallel with a first end of the first horizontal section, wherein the first end of the first horizontal section is generally perpendicular to the first side of the first horizontal section.

6. A platform system as described in claim 1, the connector comprising a plurality of connectors, each connector of the plurality of connectors comprising a top member, the top member comprising a plurality of vertical protrusions that extend downwardly from the top member of the connector, wherein a vertical protrusion of the each connector of the plurality of connectors is inserted into and retained within an annular receptacle of the plurality of annular receptacles of the first horizontal section and another vertical protrusion of each connector of the plurality of vertical protrusions is inserted into and retained within an annular receptacle of the plurality of annular receptacles of the second horizontal section and connecting the first horizontal section to the second horizontal section, and wherein a top surface of the top member of each connector of the plurality of connectors does not extend above a top plane of the first horizonal section or a top plane of the second horizontal section, and wherein the first horizontal section and the second horizontal section are in a side by side relationship with each other, and the each annular receptacle of the plurality of annular receptacles of the first horizontal section is aligned with one of the annular receptacles of the second horizontal section.

7. A platform system as described in claim 1, the connector comprises a plurality of connectors wherein the plurality of connectors each comprise four (4) vertical protrusions extending downwardly from a top member, and wherein the four (4) vertical protrusions engage the first horizontal section, the second horizontal section, a third horizontal section and a fourth horizontal section on a corner of each of the first horizontal section, the second horizontal section, the third horizontal section and the fourth horizontal section.

8. A platform system as described in claim 1, wherein:

the first horizontal section comprises a receptacle of the plurality of annular receptacles on each of four corners of the first horizontal section, and the second horizontal section comprises a receptacle of the plurality of annular receptacles on each of four corners of the second horizontal section, and wherein a first connector is present within the receptacle on a first corner of the first horizontal section and the first connector is present within the receptacle on a first corner of the second horizontal section and the first connector joins the first corner of the first horizontal section to the first corner of the second horizontal section, and wherein a second connector is present within the receptacle on a second corner of the first horizontal section and the second connector is present within the receptacle on a second corner of the second horizontal section and the second connector joins the second corner of the first horizontal section to the second corner of the second horizontal section; and wherein the first horizontal section comprises at least two receptacles of the plurality of annular receptacles on a first side thereof, and the second horizontal section comprises at least two side receptacles of the plurality of annular receptacles on a first side thereof, and a connector is present within the at least two side receptacles of the plurality of annular receptacles on the first side of the first horizontal section and the connector is present within the at least two receptacles of the plurality of annular receptacles on the first side of the second horizontal section.

9. A platform system as described in claim 1, wherein the first horizontal section comprises a single receptacle on each of four corners of the first horizontal section and a double, side by side receptacle on each side of four sides of the first horizontal section.

10. A platform system as described in claim 1, wherein the annular receiving aperture formed in the interior of the first horizontal section has an elongated shape.

11. A platform system as described in claim 1, wherein a side of the first horizontal section comprises a semi-aperture and a side of the second horizontal section comprises a semi-aperture, and wherein when the side of the first horizontal section is positioned to abut the side of the second horizontal section, and the semi-aperture of the first horizontal section and the semi-aperture of the second horizontal section are aligned to form an elongated and annular receiving aperture that is between the first horizontal section and the second horizontal section wherein the elongated and annular receiving aperture so formed is constructed and arranged to receive a blade of a vertical divider.

12. A platform system as described in claim 1, wherein the first horizontal section and the second horizontal section are rectangular and not square.

13. A platform system as described in claim 1, wherein the first horizonal section is formed in a generally rectangular shape with a first side of the generally rectangular shape of the first horizontal section being about one and one-half times as long as a second side of the generally rectangular shape of the first horizontal section.

14. A platform system as described in claim 1, wherein the first horizontal section and the second horizontal section are each formed as a unitary member, and each of the first horizontal section and the second horizontal section comprise a plurality of squares having a flat and planar top surface, and wherein the length of each of the first horizontal section and the second horizontal section exceeds the width of each of the first horizontal section and the second horizontal section.

15. A platform system as described in claim 1, wherein the first horizontal section and the second horizontal section are each formed as a unitary member, and each of the first horizontal section and the second horizontal section comprise a plurality of squares having a flat and planar top surface, each of said squares having substantially the same top surface area, the first horizontal section and the second horizontal section each having squares in a ratio of three (3) squares forming a length of the first horizontal section and the second horizontal section to two (2) squares forming a width of the first horizontal section and the second horizontal section.

16. A platform system, the platform system comprising;

a first horizontal section comprising a plurality of receptacles, each receptacle constructed and arranged to receive a connector therein, and a plurality of receiving apertures;

a second horizontal section comprising a plurality of receptacles, each receptacle constructed and arranged to receive a connector therein, and a plurality of receiving apertures;

a plurality of connectors inserted into the plurality of receptacles of the first horizontal section and the second horizontal section and joining the first horizontal section to the second horizontal section; and a vertical divider comprising a blade that is present within and retained by a receiving aperture of the plurality of receiving apertures of the first horizontal section, wherein the vertical divider is held in position by engagement of the blade with the receiving aperture of the first horizontal section, wherein the vertical divider comprises a hook on a first end thereof and the vertical divider comprises a hook on a second end thereof that is positioned lower than the hook of the first end, the hook on the second end having an aperture formed therein and constructed and arranged to receive a hook of a first end of a second vertical divider.

17. A platform system as described in claim 16, wherein the vertical divider comprises a plurality of spaced apart guides along a length of the first end, and the vertical divider comprises a hook on a second end thereof that is positioned lower than the hook of the first end, the hook on the second end having an aperture formed therein and constructed and arranged to receive a hook of a first end of a second vertical divider, and the second end of the vertical divider comprising a plurality of spaced apart guides along a length of the second end of the vertical divider that receive and retain the first end of the second vertical divider.

18. A platform system, the platform system comprising;

a first horizontal section comprising:

a plurality of receptacles, each receptacle constructed and arranged to receive a connector therein;

a first plurality of receiving apertures formed in an interior of the first horizontal section; and a second plurality of receiving apertures formed in the interior of the first horizontal section, wherein the first plurality of receiving apertures of the first horizontal section comprises one and one half times as many receiving apertures as the second plurality of receiving apertures of the first horizontal section, and wherein the first plurality of receiving apertures of the first horizontal section is disposed at about 90 degrees to the second plurality of receiving apertures of the first horizontal section; and a vertical divider comprising a blade that is present within and retained by a receiving aperture of the first plurality of receiving apertures of the first horizontal section or a receiving aperture of the second plurality of receiving apertures of the first horizontal section;

a first side, the first side comprising a first annular receptacle of the plurality of receptacles constructed and arranged to receive a connector therein, the first annular receptacle of the first side positioned at about one-third of the distance from an end of the first side, and the first side comprising a second annular receptacle of the plurality of receptacles constructed and arranged to receive a connector therein, the second annular receptacle of the first side positioned at about two-thirds of the distance from the end of the first side; and a second side joining the first side at about 90 degrees, the second side comprising an annular receptacle of the plurality of receptacles constructed and arranged to receive a connector therein, the annular receptacle of the second side positioned at about one-half of the distance from an end of the second side.

19. A platform system as described in claim 18, wherein the first horizonal section is formed in a generally rectangular shape with a first side of the generally rectangular shape of the first horizontal section being about one and one-half times as long as a second side of the generally rectangular shape of the first horizontal section.

20. A platform system as described in claim 18, the first horizontal section further comprising an annular receptacle constructed and arranged to receive a connector therein positioned on each of four (4) corners of the first horizontal section.

* * * * *